US005456809A

United States Patent [19]

Cooper

[11] Patent Number: 5,456,809

[45] Date of Patent: Oct. 10, 1995

[54] ELECTROCHEMICAL MERCERIZATION, SOURING, AND BLEACHING OF TEXTILES

[75] Inventor: John F. Cooper, Oakland, Calif.

[73] Assignee: Regents of the University of California, Oakland, Calif.

[21] Appl. No.: 384,082

[22] Filed: Feb. 6, 1995

[51] Int. Cl.[6] ..... D06M 11/00; C25B 1/30

[52] U.S. Cl. ..... 204/132; 204/133; 204/84; 204/254; 204/255; 204/257; 204/263; 8/930; 8/931

[58] Field of Search ..... 204/132, 133, 204/84, 254, 255, 256, 257, 258, 263, 265; 8/930, 931

[56] References Cited

U.S. PATENT DOCUMENTS 4,319,973 3/1992 Porta et al. ..... 204/133

FOREIGN PATENT DOCUMENTS 1181157 4/1962 Germany ..... 204/132
1689467 7/1991 U.S.S.R. .

*Primary Examiner*—John Niebling
*Assistant Examiner*—Arun S. Phasge
*Attorney, Agent, or Firm*—Henry P. Sartorio; Daryl S. Grzybicki

[57] ABSTRACT

Economical, pollution-free treatment of textiles occurs in a low voltage electrochemical cell that mercerizes (or scours), sours, and optionally bleaches without effluents and without the purchase of bulk caustic, neutralizing acids, or bleaches. The cell produces base in the cathodic chamber for mercerization and an equivalent amount of acid in the anodic chamber for neutralizing the fabric. Gas diffusion electrodes are used for one or both electrodes and may simultaneously generate hydrogen peroxide for bleaching. The preferred configuration is a stack of bipolar electrodes, in which one or both of the anode and cathode are gas diffusion electrodes, and where no hydrogen gas is evolved at the cathode.

18 Claims, 5 Drawing Sheets

ELECTROCHEMICAL MERCERIZATION, SOURING, AND BLEACHING OF TEXTILES

The United States Government has rights in this invention pursuant to Contract No. W-7405-ENG-48 between the United States Department of Energy and the University of California for the operation of Lawrence Livermore National Laboratory.

BACKGROUND OF THE INVENTION

1. Field of the Invention

The present invention relates to an electrochemical process and cell for mercerizing, souring, and bleaching textiles such as cotton fabrics, mixed fabrics, and paper products.

2. Description of Related Art

Mercerization is a textile treatment process that uses caustic solutions to modify the structure of cotton to improve dye affinity and uptake. Mercerization also improves the strength and luster of the fabric. A process similar to mercerization, scouring, uses a lower concentration of caustic (0.5–6.0% vs. ~22%) to remove dirt, oils, and sizing agents from fabrics. After a fabric is mercerized, the last traces of caustic are removed, first by washing and then by an acid neutralization treatment called souring. Souring treats the mercerized material with an acid to remove residual base.

In addition to mercerization and souring, the cotton fabrics are often bleached by adding oxidants to either the mercerizing or souring bath, or in separate unit processes. Bleaching is used to disinfect and remove color from the mercerized fabric. Typical bleaches include hypochlorite in caustic, hydrogen peroxide, perborates, perphosphates, and sometimes ozone. Bleaching generates large quantities of wash water and requires large purchases of bleaches each year.

Approximately five billion pounds of cotton-based fabrics are mercerized and soured annually in the United States. Large quantities of wash water, caustic, and neutralizing acid are consumed by the textile industry each year. The spent caustic, souring, and washing waters are often recycled by filtering and concentrated by evaporation to reduce waste of these materials.

Because of the high cost, energy consumption, and effluent production in the conventional mercerization process, an improved process for textile treatment is needed that can achieve mercerization, souring, and bleaching at a lower cost, with lower energy demands, and with reduced effluent. Since water can be electrolyzed to produce acids, bases, and hydrogen peroxide bleach, the concept of using electrolysis of neutral solutions to make base for mercerization of fabrics has been investigated.

A Soviet technique employs electrochemical treatment of a cotton fabric in aqueous solution of sodium sulfate using controlled current density between two electrodes. (See Bogdanovskaya, V. A., Krupennikova, S. N., and Zakharov, A. G., "Mercerization and electrochemical sanitation of cotton fabric", Soviet Certificate of Authorship and Soviet Patent SU 1689467, Nov. 7, 1991.) At the cathode, water is reduced to form hydrogen gas and base. At the anode, water is oxidized to produce oxygen gas and acid. Favorable results in the treatment of unmercerized cotton were reported.

A preferred process for mercerization of textiles would not produce hydrogen gas bubbles in the production of caustic compound, thereby avoiding the need to mitigate hazards associated with the evolution of hydrogen gas. In addition, an improved process would bleach the fabric in addition to mercerizing and souring. Reductions in energy requirements, effluent production, and reagent volume are clearly desirable. The present invention satisfies these conditions and can be used to mercerize, sour, and bleach textiles using a monopolar or bipolar electrochemical cell.

SUMMARY OF THE INVENTION

The present invention is an electrochemical process and cell for mercerizing, souring, and bleaching textiles, such as cotton fabrics, rag or pulp paper products, and other cellulose materials. The electrochemical cell consists of a cathode, which generates a base and optionally hydrogen peroxide, and an anode, which simultaneously produces an equivalent amount of acid for neutralization. The anode is separated from the cathode by a barrier such as a porous membrane. The cathode is preferably a gas diffusion electrode, which promotes the reduction of atmospheric oxygen to either hydroxyl ions, or alternatively to a mixture of hydroxyl ions and hydrogen peroxide. In a preferred configuration, the material first passes through the cathodic half cell to mercerize (or scour) and optionally bleach, and then passes through the anodic half cell for neutralization or souring.

The present invention has several advantages over conventional methods. One of the hazards associated with conventional methods is the evolution of hydrogen gas bubbles while generating the caustic compound. In the present method, the base and bleach are produced by the reduction of atmospheric oxygen at a gas diffusion electrode, thereby eliminating the production of hydrogen gas. In addition, these electrodes contain carbon substrates catalyzed with noble metals or organo-metallic compounds. Insufficient catalysis promotes the reduction of oxygen to hydrogen peroxide and an equivalent amount of base. The relative concentration of base and hydrogen peroxide may be controlled by the amount and activity of the catalyst. By controlling the amount of peroxide produced, the present cell can be used for bleaching, as well as mercerization and souring.

The required voltage of the present cell—about 1–1.5 V—is substantially lower than conventional cells, which typically require about 2.5 V. This reduction improves the economy of the process and is also a result of replacing the reduction of water to produce hydrogen and base with the reduction of oxygen to produce base. The electrolysis cells sustaining these reactions may be configured as a bipolar stack, in which a single bipolar gas diffusion electrode produces oxygen at one face (to sour) and consumes oxygen at the other face (to bleach and mercerize). This configuration eliminates costly current collection and distribution buses and lowers the overall current requirements of the process.

In the present process, there is no net production of base, and excessive amounts of water for washing are not required. The energy cost of this process is low—about 0.01–0.1¢/m$^2$—compared to a total processing cost of \$0.50–\$1.00/m$^2$. Gas diffusion (or air) electrodes, which are useful as cathodes, are expected to last for over 12,000 hours under sustained polarization, which should result in substantial cost savings. The cost of the counter electrode and cell separator is small by comparison with the air electrode.

DETAILED DESCRIPTION OF THE INVENTION

The present invention is a method for mercerizing, souring, and bleaching textiles using an electrochemical cell. The cathode produces base (and optionally a bleaching agent) to mercerize and bleach or sterilize textiles, and the anode generates acid to neutralize the base remaining from the mercerization process. The cell configuration allows the fabric to move through a cathode chamber bounded by the cathode, preferably a gas diffusion electrode, and by a porous separator, such as a membrane. The fabric moves through a roller separating the cathode chamber from the anode chamber, and then moves through an anode chamber bounded by the porous separator and by the anode, preferably a second gas diffusion electrode. The gas diffusion electrodes may be shared by adjacent cells, allowing the electrolysis cells to be stacked in series electrical connection.

Electrochemical Mercerization using Monopolar Impervious Electrodes

Figure 1:
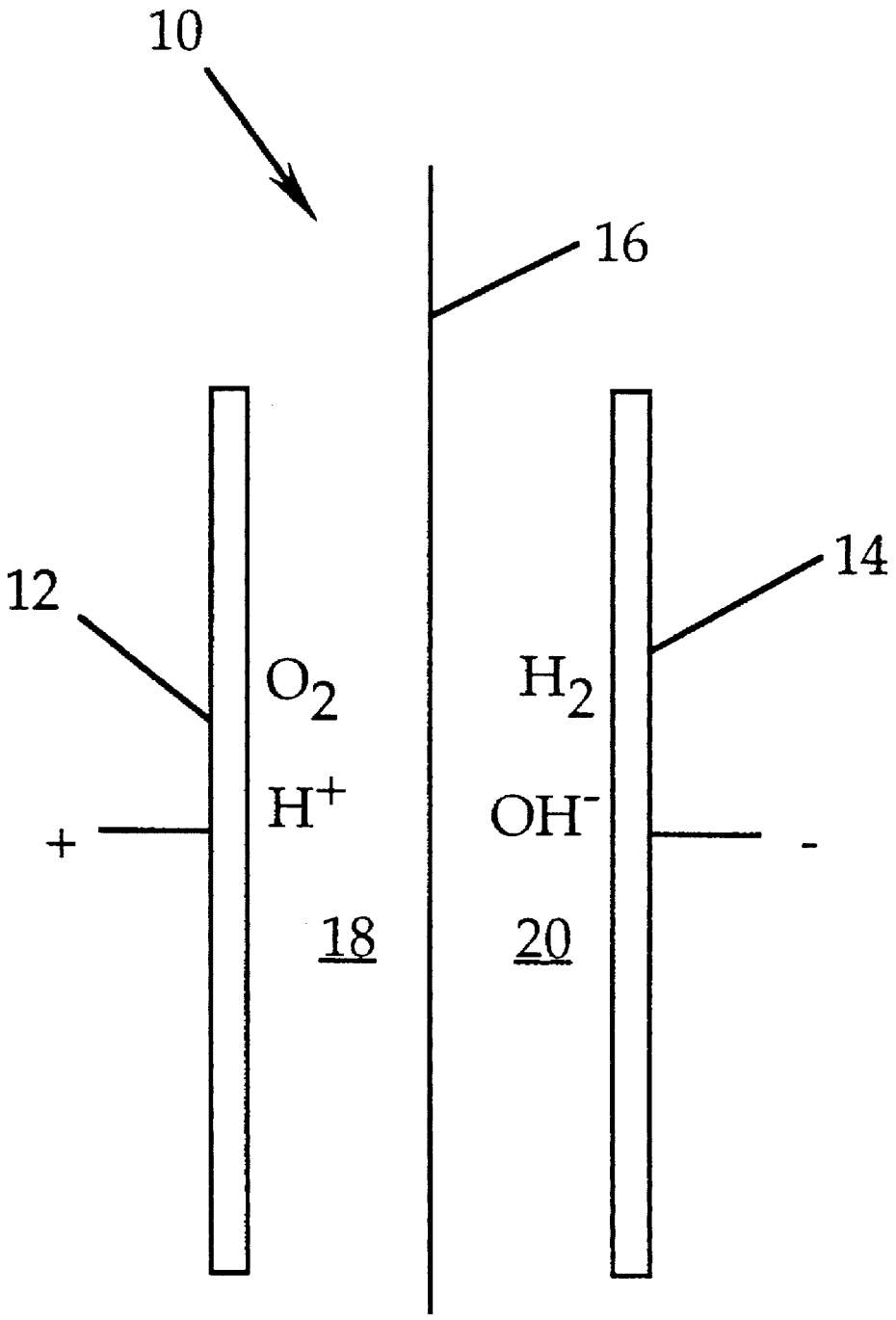
Figure 1 (Prior Art)
FIG. 1 shows a conventional electrochemical cell.

FIG. 1 illustrates a generic process of electrochemical mercerization. Electric current (DC) flows through a cell 10 from the anode 12 to the cathode 14. For purposes of illustration, the electrolyte filling the cell 10 is a 1M sodium sulfate solution. At the anode 12, water ($H_2O$) is oxidized to form oxygen gas ($O_2$) and hydrogen ions ($H^+$). The oxygen gas forms bubbles that escape from solution, and the hydrogen ions combine with sulfate ions to form sulfuric acid ($H_2SO_4$). The net reaction at the anode is the following:

$$2H_2 \Longrightarrow 4H^+ + O_2(g)\uparrow + 4e^-.$$

At the cathode 14, water is reduced to form hydrogen gas (bubbling free) and hydroxyl ions, which react with sodium ions to form sodium hydroxide (NaOH):

$$4H_2O + 4e^- \Longrightarrow 4OH^- + 2H_2(g)\uparrow.$$

Thus, the net reaction simply splits water into oxygen and hydrogen gases, with the accumulation of acid and base near the anode 12 and cathode 14, respectively:

$$6H_2 \Longrightarrow [4H^+ + O_2]_{anode} + [4OH^- + 2H_2]_{cathode}.$$

The current is carried as the hydrogen ions ($H^+$) and sodium ions ($Na^+$) travel from the anode 12 to the cathode 14, and as hydroxyl ions ($OH^-$) and sulfate ions ($SO_4^{2-}$) travel from the cathode 14 to the anode 12. As the reaction proceeds, the sodium sulfate solution is converted to sulfuric acid at the anode 12 and to sodium hydroxide at the cathode 14. In an equimolar solution of either sodium sulfate and sulfuric acid or sodium sulfate and sodium hydroxide, most of the current is carried by the hydrogen ions and hydroxyl ions, respectively, since these ions are smaller and more mobile than the sulfate ions and sodium ions.

By placing fabric 16 in the middle of the cell 10 and preventing bulk mixing of the electrolytes between the anode chamber 18 and cathode chamber 20, the fabric 16 is exposed to base in the cathode chamber 20 at the cathode 14, where mercerization occurs by chemical modification of the cellulose. The base diffusing through the fabric 16 is neutralized in the anodic chamber 18 by the acid produced at the anode 12. Since equivalent amounts of acid and base are produced at the anode 12 and cathode 14, no net production of either occurs—a consequence of reactions supported by the two electrodes and Faraday's law. This conventional process is highly inefficient because the acid and base tend to neutralize the solution within the fabric 16.

Electrochemical Mercerization using Monopolar Gas Diffusion Electrodes

Figure 2:
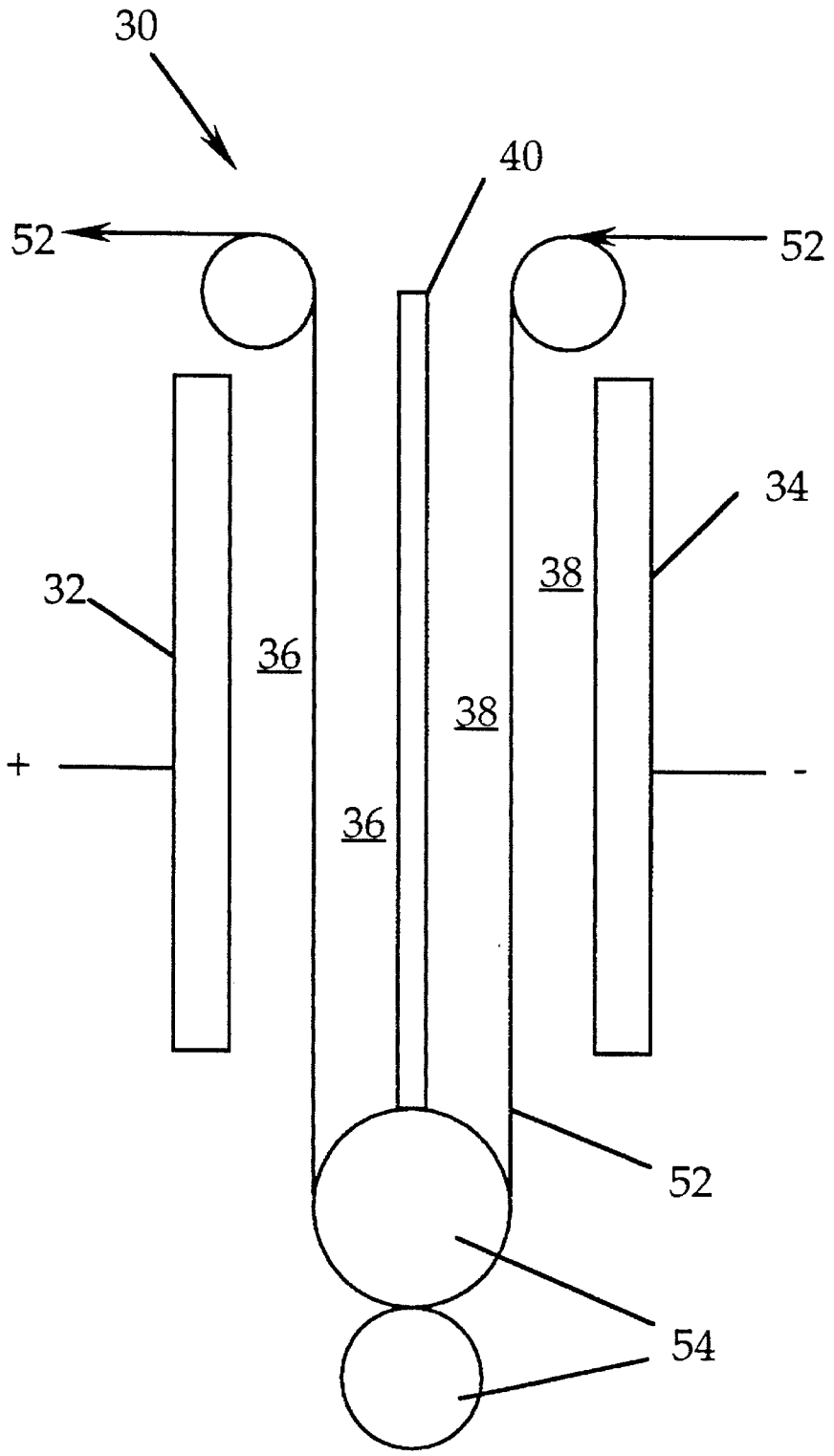
FIG. 2 shows a monopolar electrochemical mercerization cell using gas diffusion electrodes.

FIG. 2 illustrates the use of gas diffusion electrodes in a monopolar electrochemical mercerization cell according to the present invention. Gas diffusion electrodes may be used either for the cathode or the anode, or for both. Electrical current flows through the cell 30 from the anode 32 to the cathode 34. The cell 30 is separated into an anode chamber 36 and a cathode chamber 38 by a porous, electrolyte-saturated or ion-conducting, liquid-impervious separator 40, such as a membrane (e.g., Nafion).

The separator 40 prevents mixing of the electrolyte solutions that occupy the chambers 36,38. The electrolyte may be a water-based solution of an alkali metal or alkaline earth sulfate, bisulfate, phosphate, monohydrogen phosphate, dihydrogen phosphate, chloride, nitrate, carbonate, bicarbonate, or a water-soluble mixture of these salts. Sodium sulfate is preferred because it is benign, inexpensive, and has shown favorable results in mercerizing. Typically, the same starting electrolyte solution is used in both chambers 36,38.

The flow of ionic current by the hydrogen ions and hydroxyl ions tends to nullify the build-up of acid and base in the anode and cathode chambers, respectively. For this reason, it is preferable to have a large excess of the slower ions (sodium and sulfate) and a high concentration of supporting electrolyte. For example, concentrations of 1–3M sodium sulfate will carry the majority of the current until the acid and base concentrations reach 0.1–0.3M. To achieve higher concentrations of acid and base in the chambers, an ion-conducting separator 40 is used to enhance the current carried by the sodium ions.

At the cathode 34, oxygen is reduced to form base for mercerization and may also produce hydrogen peroxide, which can be used for bleaching. Since mercerization and scouring have similar operating conditions (except for different concentrations of base), any reference to electrochemical mercerization also includes electrochemical scouring. The anode 32 produces oxygen and acid, and may provide means of transporting oxygen out of the system without bubbling through the electrolyte. Hydrogen peroxide may also be produced at the anode 32.

Figure 3:
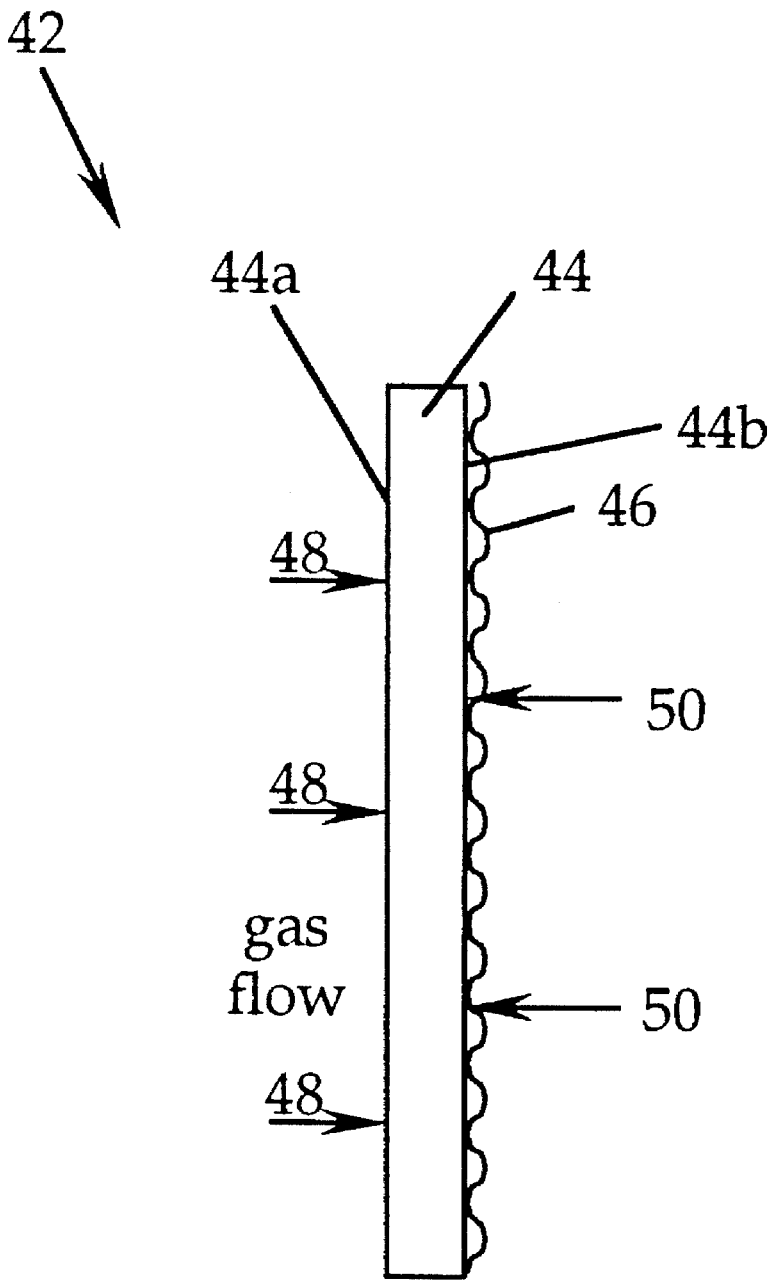
Figure 3 (Prior Art)
FIG. 3 shows a conventional gas diffusion electrode.

FIG. 3 shows a gas diffusion electrode 42, which is a porous, electronically conductive structure. The electrode 42 provides intimate contact between a gas, an electrolyte, an electronically conducting substrate 44, and an electronic current collector 46. The gas, such as oxygen or air, diffuses into one surface of the substrate 44*a* as shown by arrows 48. The electrolyte diffuses into the other surface of the substrate 44*b* as shown by arrows 50. The electronically conducting substrate 44 is typically made of carbon particles held together with binders or is a porous metal structure. The electronic current collector 46 is typically a conductive metal screen.

The substrate 44 may be catalyzed to achieve (with appropriate polarization) either the reduction of oxygen to base or the oxidation of water to oxygen. Often, the porous structure 44 is treated with a hydrophobic material on the gas side 44*a* to prevent wetting or leakage, and with a hydrophilic material on the electrolyte side 44*b* to assist in wetting of the substrate 44.

Another type of gas diffusion electrode has no discrete hydrophobic and hydrophilic layers, but micropores having either hydrophilic or hydrophobic properties permeate the entire structure in parallel layers. In this form of diffusion electrode, the capillary properties of the pores separate the two phases and prevent bulk transport of air into the electrolyte side and vice versa.

The gas diffusion electrodes can be modified with appropriate catalysis to produce hydrogen peroxide in addition to either acid or base. The hydrogen peroxide may be used to bleach the fabric. The distribution of reactions depends on the electrical polarization of the electrode and on the amount of catalytic material on the electrode.

At least 1.23 V is required to break water down into hydrogen and oxygen gases in a neutral electrolyte, and in a practical system, typically at least 1.7 V is needed. The pH difference between the anode and cathode may be as high as 12 or 13, which requires a thermodynamic potential difference of about 60 mV per pH unit, raising the cell voltage to about 2.4–2.5 V. However, if oxygen is reduced at the cathode instead of breaking down water and evolving hydrogen gas, then the cell voltage will be about 1.2–1.5 V. Thus, in the present invention, about 1 V is saved by using oxygen-reducing electrodes rather than hydrogen-evolving electrodes.

Oxidation Reaction

The anodic side of the cell 30 in FIG. 2 sustains the following reaction:

$$2H_2 \Longrightarrow 4H^+ + O_2(g)\uparrow + 4e^-.$$

The oxygen gas does not bubble into the electrolyte solution when a gas diffusion electrode 42 (as shown in FIG. 3) is used. Instead, the oxygen gas is preferentially formed at the gas/electrolyte interface within the substrate 44, where it enters the gas phase and diffuses to the outer surface 44*a* of the substrate 44. The anodic reaction requires a catalyst to promote the oxidation of water to oxygen. In addition, the anodic reaction may form hydrogen peroxide with the acid—a partial oxidation of water to oxygen. With the proper catalyst, hydrogen peroxide forms by this reaction:

$$2H_2 \Longrightarrow H_2O_2 + 2H^+ + 2e^-.$$

The relative proportion of oxidation products (hydrogen peroxide and acid) depends on the amount and nature of catalytic material on the anode. Uncatalyzed carbon, for example, tends to promote production of hydrogen peroxide in addition to acid and oxygen. Certain metal oxide catalysts promote full and quantitative oxidation of water to oxygen gas and acid.

Reduction Reaction

In the cathode, the products of the reduction of water are also controlled by the nature and degree of catalysis. Uncatalyzed carbon gas diffusion electrodes 42 flooded with oxygen gas will tend to reduce oxygen to form hydrogen peroxide as well as base (hydroxyl ions). Note that hydrogen gas, a potentially dangerous product, is not formed in the present invention. The net reaction at the cathode 34 shown in FIG. 2 is the following:

$$2O_2 + 4H_2O + 4e^- \Longrightarrow 2H_2O_2 + 4OH^-.$$

The hydrogen peroxide diffuses into the electrolyte along with base. If certain catalysts (such as platinum, platinum alloys, silver, or cobalt porphyrin complexes) are used that promote reduction of hydrogen peroxide to water or decomposition of hydrogen peroxide to oxygen and water, then the peroxide concentration remains at very low levels. Then base is produced within the cathode 34 by the following net cathode reaction:

$$O_2 + 2H_2O + 4e^- \Longrightarrow 4OH^-.$$

In summary, the anode 32 in FIG. 2 consumes water to produce acid and oxygen, or alternatively hydrogen peroxide in addition to acid and oxygen. The cathode 34 consumes oxygen to produce base, or alternatively hydrogen peroxide and base. The fabric 52 to be mercerized enters the cathode chamber 38 and is mercerized (and possibly bleached) by the products of the cathodic reaction. The fabric 52 then passes through rollers 54 that prevent bulk mixing of anodic and cathodic electrolytes and then enters the anode chamber 36. Any entrained base is neutralized by the acid produced by the anode 32.

Electrochemical Mercerization using Bipolar Gas Diffusion Electrodes

Figure 4:
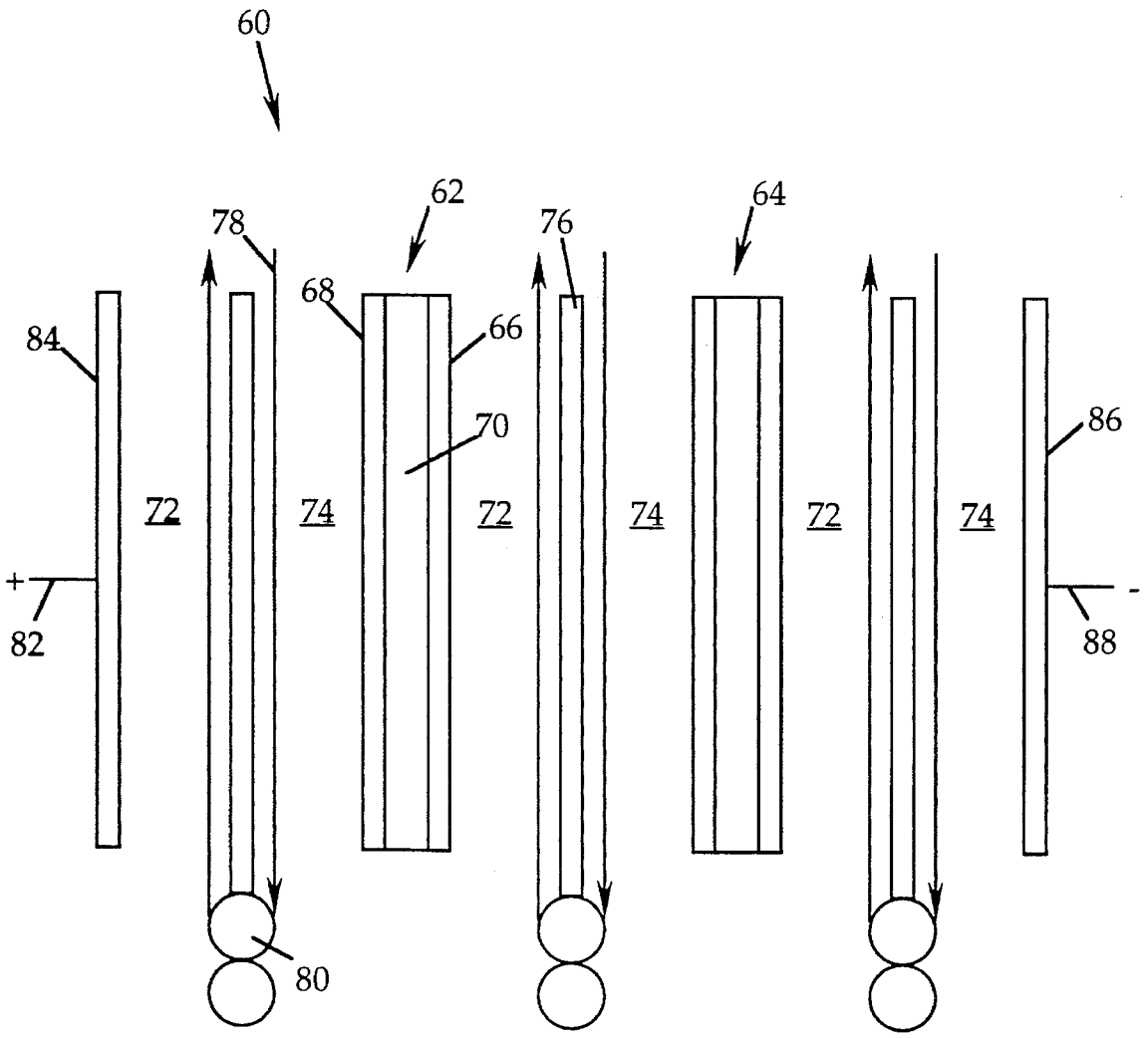
FIG. 4 shows a bipolar electrochemical mercerization cell having a stack of bipolar gas diffusion electrodes.

Whereas FIG. 2 shows the use of gas diffusion electrodes for oxygen evolution and/or oxygen reduction in a monopolar configuration, FIG. 4 shows a preferred embodiment of the invention in which the gas diffusion anode and cathode are connected in a bipolar cell configuration. A bipolar electrode is a roughly planar electrode that sustains an oxidation reaction on one face and an equivalent reduction reaction on the opposite face, and passes an electronic current from the cathode surface to the anode surface uniformly across the surface and perpendicular to the primary plane of the electrode surface.

There are several advantages to the bipolar configuration over the monopolar configuration. For example, there is no need for current collection leading to an external current bus, which is cumbersome in a plant setting and expensive due to the large amounts of copper or aluminum conductors required. Also, many bipolar cells may be stacked in electrical series, which have electrical requirements that are higher in voltage but lower in total current. Lower current represents a savings in rectification costs and in the mass of conductors required to carry the current.

FIG. 4 shows the electrochemical mercerization of cotton-based fabrics using an electrochemical bipolar cell stack 60 with two identical bipolar electrodes 62,64. Although two are illustrated, many more electrodes may be stacked in series. One face of the bipolar gas diffusion electrode 62 is the anode 66, which generates oxygen and acid. The opposite face of the same bipolar electrode 62 is the cathode 68, which consumes the oxygen to produce base and optionally hydrogen peroxide. Electrical current enters the cell 60 at an anode end bus 82 and through an anode endplate 84, passing through all the electrodes 62,64 in series connection, and then exits the cell stack 60 through a cathode endplate 86 and cathode end bus 88.

Between the anodic and cathodic surfaces is a porous, electron-conducting spacer region 70 for shorting adjacent electrodes. The spacer 70 is a means of transporting gas through a space between the anodic and cathodic surfaces to allow transport of heat and flow of oxygen or air. The space between the electrodes 62,64 and between the electrodes 62,64 and the endplates 84,86 is separated into an anode chamber 72 and a cathode chamber 74 by a medial porous separator 76. The separator 76 is typically an ion-permeable or porous membrane, such as an ion-conducting polymer or a porous frit, respectively, which prevents gross mixing of the electrolytes filling the anode and cathode chambers 72,74.

To process a textile material, the material 78 to be mercerized enters a cathode chamber 74 of the cell 60. As in the monopolar cell, the cathodic reaction brings about mercerization. The material 78 then passes through a roller 80 or squeegee and enters an anode chamber 72. The roller 80 is a means of preventing bulk transport of electrolyte from the cathode chamber 74 to the anode chamber 72, and may be used to reverse the direction of the material 78 (from downwards to upwards). The anodic reaction causes neutralization (souring) of the small amount of base carried with the material 78 as it travels from the cathode chamber 74. The catalytic properties of the bipolar anode 66 or cathode 68 may be modified to produce a net amount of hydrogen peroxide for use as a bleach or disinfectant.

In the simplest configuration, the bipolar gas diffusion electrode is made of two back-to-back gas diffusion electrodes. At the anode surface, an amount of pure oxygen is produced that is equal to the amount consumed at the cathode surface, so that the net reaction is the transport of oxygen from anode chamber to adjacent cathode chamber. Thus, the net reaction of the base-producing cell is represented as:

$$O_2(\text{anode} \Longrightarrow O_2(\text{cathode}).$$

Figure 5:
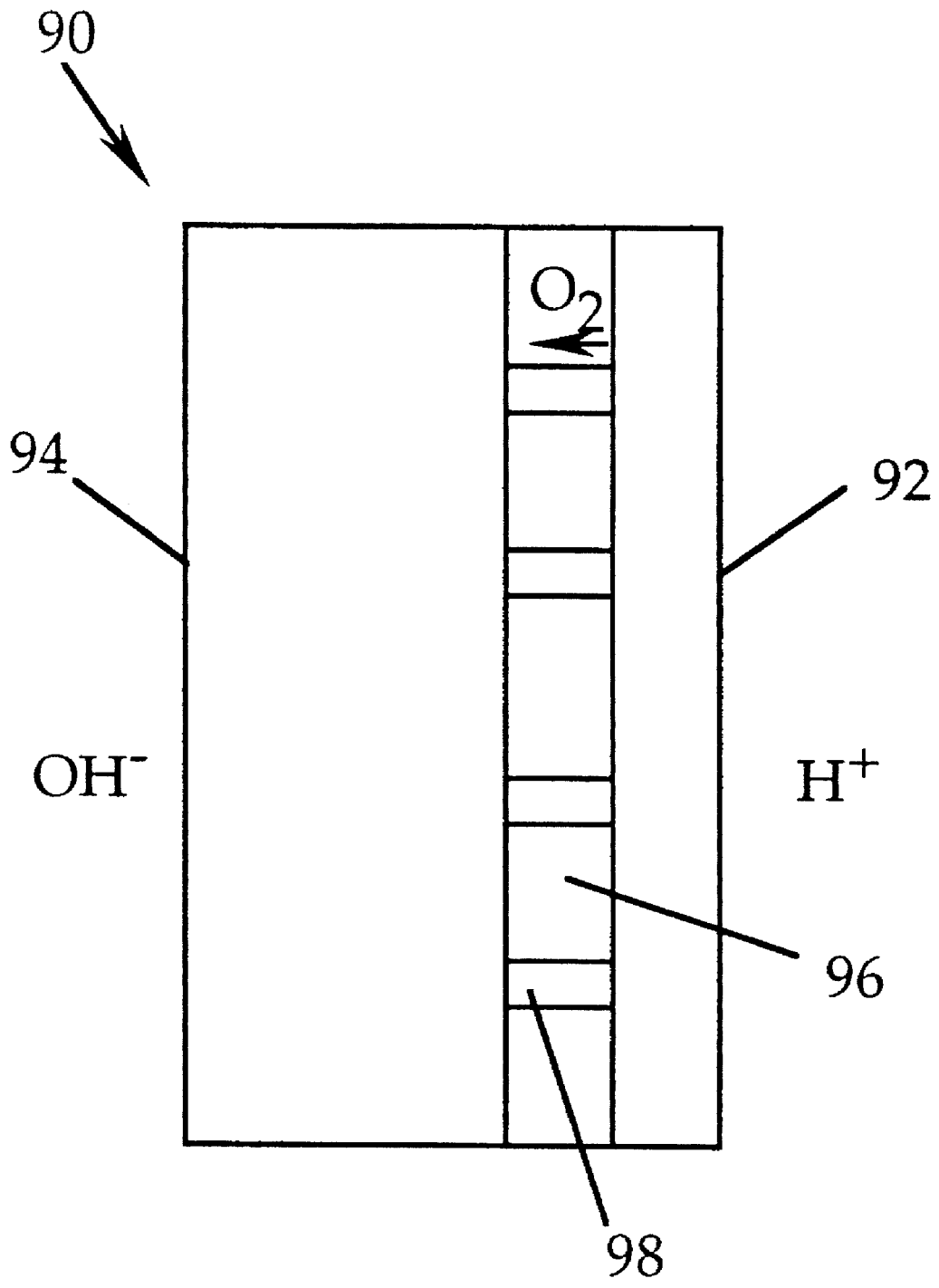
Figure 5 (Prior Art)
FIG. 5 shows a bipolar electrode having a gas diffusion cathode and an impervious anode with internal oxygen transport.

FIG. 5 shows an alternative configuration of a bipolar electrode 90. One face of the bipolar electrode 90 has an oxygen-evolving, electrolyte- and gas-impervious electrode (anode) 92. The other face is an oxygen-reducing gas diffusion electrode (cathode) 94. The anode 92 may comprise a metal, graphite, or any other electronically conducting, electrolyte-impervious material. The electrode reactions are the same as in the configurations shown in FIGS. 2 and 4.

In the space between the anode 92 and cathode 94 is an internal medial channel 96 to permit the flow of oxygen or oxygen-containing gas. Oxygen is supplied in the hollow interior of the bipolar electrode 90 from without the cell by pumping air, oxygen, or another oxygen-containing gas. The interior channel 96 also contains means 98 for conducting electronic current from the cathode to the anode. The means 98 do not prevent the flow of gas parallel to the anodic and cathodic surfaces, which allows direct contact with the pores of the gas diffusion electrode 94.

This bipolar electrode 90 is advantageous when gas evolution can be tolerated within the anode chamber to provide a means of stirring the electrolyte during the neutralization process. An important advantage of the bipolar electrode containing one gas conducting diffusion electrode is cost. In general, impervious gas evolving anodes are cheaper, more rugged, and longer lived than gas diffusion electrodes, cutting the cost of the gas diffusion bipolar electrode roughly in half.

The bipolar electrode, consisting of one gas diffusion cathode and one electrolyte- and gas-impervious oxygen electrode, produces an amount of pure oxygen at the anode surface that is exactly equal to the amount of oxygen consumed at the cathode surface, such that the net reaction is the transport of oxygen from anode chamber to adjacent cathode chamber. In practical application, filtered air may be pumped slowly through the bipolar structure. Alternatively, air enriched with the oxygen off-gas from the anode chambers may be used. If the oxygen from the anode is collected and recycled through an external manifold to the cathodes, then the cell voltage decreases by a small amount.

In a second embodiment of the bipolar electrode 90, the oxygen-evolving electrode 92 is porous (allowing oxygen to diffuse into the medial chamber 96) and hydrophobic (preventing leakage of electrolyte into the medial chamber 96). The anode 92 produces and transmits to the cathode 94 that amount of oxygen that is required to sustain the reduction reaction. The anodic and cathodic reactions are not perfectly efficient in the amount of oxygen produced and consumed per unit reaction. Therefore, the medial chamber 96 should be open to the ambient atmosphere.

The foregoing description of preferred embodiments of the invention is presented for purposes of illustration and description and is not intended to be exhaustive or to limit the invention to the precise form disclosed. Many modifications and variations are possible in light of the above teaching.

I claim:

1. A method for mercerizing textile materials, using an electrochemical cell, comprising:

producing a base for mercerization by reducing oxygen at a gas diffusion cathode in a cathodic chamber filled with an electrolyte solution in an electrochemical cell;

producing an acid for neutralization by oxidizing water at an anode in an anodic chamber filled with a second electrolyte solution in the cell;

maintaining separation of the electrolyte solutions in the anodic and cathodic chambers; and moving a textile material through the cathodic chamber where the material is in contact with the base and then through the anodic chamber where the material is in contact with the acid.

2. The method as recited in claim 1, further comprising:

producing hydrogen peroxide for bleaching or sterilizing the material by reducing oxygen gas at the cathode.

3. The method as recited in claim 1, further comprising:

producing hydrogen peroxide for bleaching or sterilizing the material by oxidizing oxygen gas at the anode.

4. The method as recited in claim 1, further comprising:

producing oxygen gas at the anode.

5. The method as recited in claim 1, wherein the cathode and anode produce substantially equivalent amounts of base and acid, respectively.

6. The method as recited in claim 1, wherein hydrogen gas is not produced at the cathode.

7. An electrochemical cell for mercerizing textile materials, comprising:

a cathode, wherein oxygen is reduced at the cathode to form a base for mercerizing a textile material;

an anode, wherein water is oxidized at the anode to form an acid for neutralizing the material;

wherein at least one of the cathode and anode is a gas diffusion electrode;

a separator situated between the anode and cathode, defining a cathodic chamber bounded by the cathode on one side and the separator on another side, and an anodic chamber bounded by the anode on one side and the separator on another side; and means for moving the textile material through the cathodic chamber and through the anodic chamber.

8. A cell as recited in claim 7, wherein the cathode comprises a catalyst for producing hydrogen peroxide at the cathode in addition to base.

9. A cell as recited in claim 7, wherein the anode comprises a catalyst for producing hydrogen peroxide at the anode in addition to acid.

10. A cell as recited in claim 7, wherein both the cathode and the anode are gas diffusion electrodes.

11. A cell as recited in claim 7, wherein the cathode and anode are monopolar electrodes.

12. A cell as recited in claim 7, wherein the cathode and anode comprise a bipolar electrode.

13. A cell as recited in claim 12, further comprising a plurality of bipolar electrodes.

14. A cell as recited in claim 12, wherein the anode is an electrolyte-impervious anode.

15. A cell as recited in claim 12, wherein the cathode and anode are gas diffusion electrodes.

16. A cell as recited in claim 7, wherein an electrolyte solution occupies each of the chambers, and wherein the separator is porous or ion-conducting and prevents mixing of the electrolyte solutions between the anodic and cathodic chambers.

17. A cell as recited in claim 16, wherein the means of moving the material comprises rollers that prevent mixing of the electrolyte solutions between the anodic and cathodic chambers.

18. A cell as recited in claim 7, wherein the cell has a required voltage of less than about 1.5 V.

* * * * *